US005839330A

United States Patent [19]

Stokka

[11] Patent Number: 5,839,330

[45] Date of Patent: Nov. 24, 1998

[54] MECHANISM FOR CONNECTING AND DISCONNECTING TUBULARS

[75] Inventor: Arnold Stokka, Sandnes, Norway

[73] Assignee: Weatherford/Lamb, Inc., Houston, Tex.

[21] Appl. No.: 812,402

[22] Filed: Mar. 5, 1997

[30] Foreign Application Priority Data

Jul. 31, 1996 [GB] United Kingdom ..... 9616094

[51] Int. Cl.[6] ..... B25B 13/50

[52] U.S. Cl. ..... 81/57.33; 81/57.15; 81/57.34

[58] Field of Search ..... 81/57.33, 57.15, 81/57.16, 57.17, 57.34

[56] References Cited

U.S. PATENT DOCUMENTS

| | | | |
|---|---|---|---|
| 2,668,689 | 2/1954 | Cormany . | |
| 2,862,690 | 12/1958 | Mason | 81/57.33 |
| 4,372,026 | 2/1983 | Mosing . | |
| 4,401,000 | 8/1983 | Kinzbach . | |
| 4,442,736 | 4/1984 | True et al. . | |
| 4,570,706 | 2/1986 | Pugnet . | |
| 4,604,922 | 8/1986 | Soutsos | 81/57.17 |
| 4,753,300 | 6/1988 | Shaw et al. . | |
| 4,843,924 | 7/1989 | Hauk | 81/57.17 |
| 4,867,236 | 9/1989 | Haney et al. | 81/57.33 |
| 5,036,927 | 8/1991 | Willis . | |
| 5,161,439 | 11/1992 | Wesch, Jr. . | |
| 5,271,298 | 12/1993 | Gazel-Anthoine | 81/57.34 |

FOREIGN PATENT DOCUMENTS

| | | |
|---|---|---|
| 82/630104.6 | 6/1983 | European Pat. Off. . |
| 85/109232.0 | 2/1986 | European Pat. Off. . |
| 311455 | 10/1988 | European Pat. Off. . |
| 88/302818.5 | 10/1988 | European Pat. Off. . |
| 88/309434.4 | 4/1989 | European Pat. Off. . |
| 90/630125.4 | 4/1991 | European Pat. Off. . |
| 91/112981.5 | 2/1993 | European Pat. Off. . |
| 2131732 | 1/1973 | Germany . |
| 2100639 | 1/1983 | United Kingdom . |
| PCT/NO92/00157 | 4/1993 | WIPO . |
| WO 9618799 | 12/1995 | WIPO . |
| PCT/GB 95/02953 | 6/1996 | WIPO . |

OTHER PUBLICATIONS

PCT/EP97/03568 PCT, 1997, Int'l Search Report (This is the PCT counterpart of the present US Application).

*Primary Examiner*—James G. Smith
*Assistant Examiner*—Lee Wilson
*Attorney, Agent, or Firm*—Guy McClung

[57] ABSTRACT

A top drive is used to connect successive lengths of casing. The casing is gripped by a mechanism which comprises a support which is attached to the top drive by a drive plate. A circular plate is rotatably mounted in the support and is associated with four jaw assemblies. In use the mechanism is lowered onto a length of casing until the circular plate engages the top of the casing. When the top drive is rotated in one sense the support rotates relative to the circular plate. This causes toothed cylinders to rotate which, in turn, rotates eccentric members which advance the jaws into gripping engagement with the casing. Further rotation of the top drive rotates the casing and screws it into the casing below.

9 Claims, 2 Drawing Sheets

MECHANISM FOR CONNECTING AND DISCONNECTING TUBULARS

FIELD OF THE INVENTION

This invention relates to a mechanism for connecting and disconnecting tubulars, to a top drive provided with such a mechanism, and to a method of running casing using said mechanism and/or top drive.

BACKGROUND OF THE INVENTION

During the construction of oil and gas wells a hole is bored into the earth. Lengths of casing are then screwed together to form stands and lowered into the bore, inter alia to prevent the wall of the bore collapsing and to carry oil or gas to the surface.

After each stand of casing has been lowered into the bore slips are applied which support the casing whilst the next stand of casing is screwed into the casing in the slips. When the new stand of casing is connected to the casing in the slips the slips are released and the new stand lowered into the bore. This process is repeated until the desired length of casing has been lowered into the bore. In certain operations a stand of casing may comprise a single tubular.

It is important that the joints between the lengths of casing are tightened to the correct torque both to render the joint leakproof and to ensure that the casing will not part.

Historically, lengths of casing were originally connected using manually operated tongs. Later these were replaced by power operated tongs which were manoeuvred into position manually. More recently automatic tongs have been introduced which run on rails and can be advanced towards a joint or withdrawn therefrom by remote control.

Whilst power tongs have proved satisfactory for use with standard casing having a diameter up to 41 cm (16 inches), it is now becoming more common to employ casing inches), it is now becoming more common to employ casing with a diameter of from 47 cm (18⅝") to 92 cm (36").

Although automatic tongs have been built to accommodate such casing they are extremely heavy and extremely expensive.

One apparatus for rotating a drill string during drilling is known as a top drive. Top drives are generally hydraulically or electrically operated.

PCT Publication WO 96/18799 in one aspect discloses a method for connecting tubulars, which method comprises the step of rotating one tubular relative to another with a top drive. Also disclosed is an apparatus which comprises a head for gripping a length of casing and a drive shaft which extends from said head and is rotatable by a top drive.

The present invention provides a mechanism which facilitates gripping the casing.

SUMMARY OF THE INVENTION

According to one aspect of the present invention there is provided a mechanism for gripping a tubular, which mechanism comprises at least one jaw movable into engagement with said tubular, characterised in that said mechanism further comprises a support connectable to a top drive and rotatable thereby, a plate rotatable relative to said support, and means responsive to relative rotation between said support and said plate to displace said at least one jaw, the arrangement being such that, in use, when said mechanism is lowered onto a tubular, said plate engages said tubular whereafter rotation of said support in one sense creates relative rotation between said support and said plate and causes said at least one jaw to move into gripping engagement with said tubular.

Preferably, said means comprises a cylinder which engages said support and is rotatably mounted on said plate, and an eccentric member fast with said cylinder.

Advantageously, said cylinder is toothed and said support comprises a toothed track which meshes therewith.

The present invention also provides a top drive having a mechanism in accordance with the present invention attached thereto.

The present invention also provides a method of running casing, which method comprises the steps of joining said casing using a mechanism or a top drive in accordance with the present invention.

For a better understanding of the invention reference will now be made, by way of example, to the accompanying drawings in which:

DETAILED DESCRIPTION OF THE PREFERRED EMBODIMENT

Figure 1:
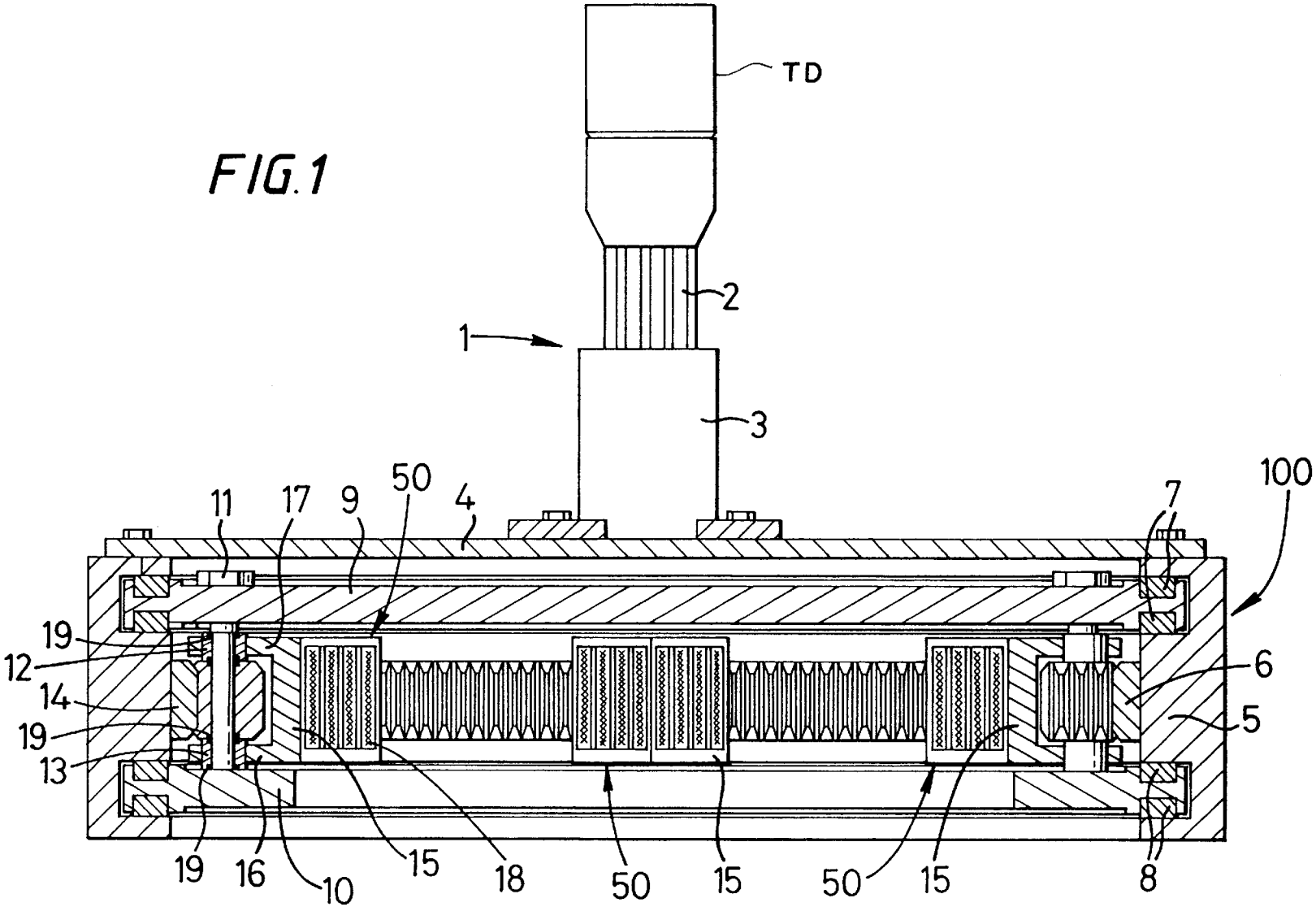
FIG. 1 is a side view, partly in cross-section, of one embodiment of a mechanism in accordance with the present invention.
Figure 2:
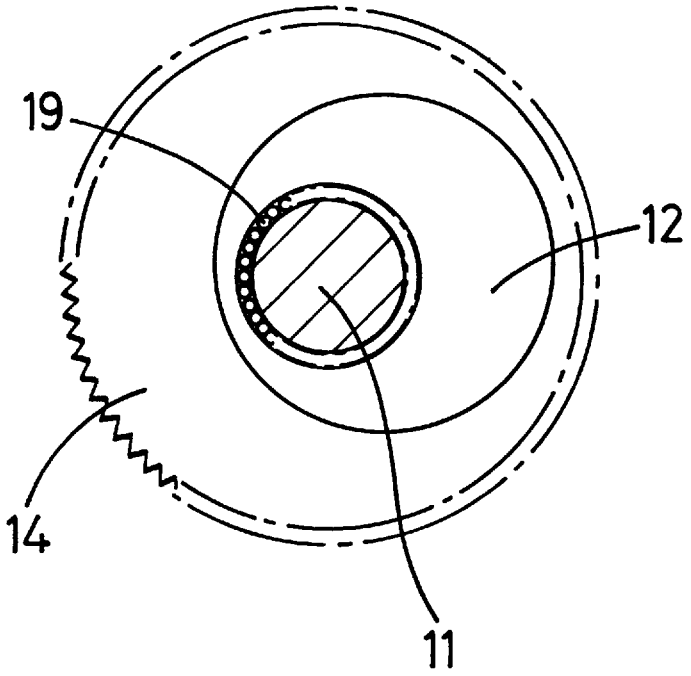
FIG. 2 is a schematic top-plan view of a part of the mechanism shown in FIG. 1.

Referring to FIG. 1, there is shown a mechanism for gripping tubulars which is generally identified by the reference numeral 100. The mechanism 100 depends from a top drive to by a telescopic drive shaft 1. The telescopic drive shaft 1 comprises an upper section 2 and a lower section 3 which are provided with interengaging external and internal splines respectively.

The lower section 3 is bolted to the mechanism 100 via a drive plate 4.

The mechanism 100 comprises an annular support 5 which is bolted to the drive plate 4. A toothed track 6 is provided on the inner surface of the annular support 5 and forms part thereof. The annular support 5 is also provided with upper bearings 7 and lower bearings 8. The upper bearings 7 support a circular rotatable plate 9 whilst the lower bearings 8 support a rotatable ring 10. The circular rotatable plate 9 is bolted to the rotatable ring 10 by long bolts 11.

The mechanism 100 includes four jaw arrangements 50. Each jaw arrangement 50 comprises an upper eccentric member 12 and a lower eccentric member 13 both of which are mounted fast on a toothed cylinder 14. The upper and lower eccentric members 12, 13 and the toothed cylinder 14 are rotatably mounted on long bolt 11 by bearings 19. If desired, the toothed cylinder 14 and the upper rand lower members 12, 13 could be machined from one piece of material.

Jaws 15 are provided with an upper lug 17 and a lower lug 16 which are each provided with holes which encircle the upper and lower eccentric members 12, 13 respectively.

The jaw arrangements 50 are spaced at 90° around the circular rotatable plate 9. The jaws 15 also comprise teeth 18 to facilitate gripping.

In use, the mechanism 100 is lowered over the top of a stand of casing (which may comprise one or more lengths of casing) to be gripped, until the rotatable plate 9 engages the top of the casing. The upper section of the casing is now surrounded by the four jaw arrangements 50. The top drive (not shown) now rotates the drive plate 4 which is bolted to the annular support 5. Due to friction between the rotatable plate 9 and the top of the casing to be gripped, the rotatable plate 9 remains stationary. The toothed track 6 rotates with the drive plate 4. This movement causes the toothed cylinder 14 to rotate about the long bolt 11. The upper and lower eccentric members 12, 13 rotate about the long bolt 11 and hence push the jaws 15 and teeth 18 inwardly to grip the outer surface of the casing.

The stand of casing can now be screwed into a string of casing to a required torque. During this step the rotatable plate 9 rotates with the top drive, drive plate 4 and the stand of casing.

After the stand of casing has been tightened to the required torque the main elevator (not shown) is applied to the stand of casing as described in WO-A-96/18799.

For release of the mechanism the top drive (not shown) rotates the drive plate 4 anti-clockwise. The annular member 5 and the toothed track 6 rotate with the drive plate 4 and this movement rotates the toothed cylinder 14 about the long bolt 11. The upper and lower eccentric members 12,13 rotate with the toothed cylinder about the long bolt 11 and pull the jaws 15 outwardly, releasing the teeth 18 from the outer surface of the casing. The top head drive (not shown) and the mechanism can now be raised away from the stand of casing.

It should be noted that the main elevator (not shown) is attached to the upper length of casing of the stand of casing before release of the mechanism. This is important as any anti clockwise torque applied to the casing during release of the mechanism is transferred to the main elevator and not through the casing string, which could reduce the torque on a connection.

Various modifications to the preferred embodiment described are envisaged. For example, the plate 9 may comprise a disc (as shown), an annulus, or even one or more segments against which the casing can abut. The lower surface of the plate 9 may be roughened or provided with friction material if desired.

Mechanisms in accordance with the present invention are particularly intended for running casing with a diameter greater than 41 cm (16 inches) and, more particularly, greater than 60 cm (24 inches). They are particularly useful with very large casing having a diameter equal to or greater than 90 cm (36 inches).

What is claimed is:

1. A mechanism for gripping a tubular, which mechanism comprises at least one jaw movable into engagement with said tubular, a support connectable to and rotatable by a top drive, a plate rotatable relative to said support, and means responsive to relative rotation between said support and said plate to displace said at least one jaw, so that, in use, when said mechanism is lowered onto a tubular, said plate engages said tubular whereafter rotation of said support in one sense creates relative rotation between said support and said plate and causes said at least one jaw to move into gripping engagement with said tubular.

2. A mechanism as claimed in claim 1, wherein said means comprises a cylinder which engages said support and is rotatably mounted on said plate, and an eccentric member secured to said cylinder.

3. A mechanism as claimed in claim 2, wherein said cylinder is toothed with teeth and said support comprises a toothed track which meshes with said teeth of said cylinder.

4. A top drive as claimed in claim 2, wherein said cylinder is toothed with teeth and said support comprises a toothed track which meshes with said teeth of said cylinder.

5. A top drive includes a mechanism for gripping a tubular, which mechanism comprises at least one jaw movable into engagement with said tubular, a support connectable to and rotatable by a top drive, a plate rotatable relative to said support, and means responsive to relative rotation between said support and said plate to displace said at least one jaw, so that, in use, when said mechanism is lowered onto a tubular, said plate engages said tubular whereafter rotation of said support in one sense creates relative rotation between said support and said plate and causes said at least one jaw to move into gripping engagement with said tubular.

6. A top drive as claimed in claim 5, wherein said means comprises a cylinder which engages said support and is rotatably mounted on said plate, and an eccentric member secured to said cylinder.

7. A method of running casing, which method comprises the step of joining lengths of casing with a top drive which includes a mechanism for gripping a tubular, which mechanism comprises at least one jaw movable into engagement with said tubular, a support connectable to and rotatable by a top drive, a plate rotatable relative to said support, and means responsive to relative rotation between said support and said plate to displace said at least one jaw, so that, in use, when said mechanism is lowered onto a tubular, said plate engages said tubular whereafter rotation of said support in one sense creates relative rotation between said support and said plate and causes said at least one jaw to move into gripping engagement with said tubular.

8. A method according to claim 7, wherein said means comprises a cylinder which engages said support and is rotatably mounted on said plate, and an eccentric member secured to said cylinder.

9. A method according to claim 8, wherein said cylinder is toothed with teeth and said support comprises a toothed track which meshes with said teeth of said cylinder.

* * * * *